US012350735B2

(12) United States Patent
Bhargava

(10) Patent No.: US 12,350,735 B2
(45) Date of Patent: Jul. 8, 2025

(54) LOST FOAM AND SAND CASTING WITH POLYLACTIC ACID- BASED FOAM ARTICLES

(71) Applicant: Lifoam Industries, LLC, Greer, SC (US)

(72) Inventor: Saumitra Bhargava, Clarksville, MD (US)

(73) Assignee: LIFOAM INDUSTRIES, LLC, Greer, SC (US)

( * ) Notice: Subject to any disclaimer, the term of this patent is extended or adjusted under 35 U.S.C. 154(b) by 0 days.

(21) Appl. No.: 18/476,909

(22) Filed: Sep. 28, 2023

(65) Prior Publication Data

US 2024/0189888 A1 Jun. 13, 2024

Related U.S. Application Data

(60) Provisional application No. 63/386,676, filed on Dec. 9, 2022.

(51) Int. Cl.
*B22C 7/02* (2006.01)
*B22C 9/04* (2006.01)

(52) U.S. Cl.
CPC ..... *B22C 7/023* (2013.01); *B22C 9/043* (2013.01); *B22C 9/046* (2013.01)

(58) Field of Classification Search
CPC ..... B22C 9/046; B22C 7/023; B22C 9/043
See application file for complete search history.

(56) References Cited

U.S. PATENT DOCUMENTS

| | | | | |
|---|---|---|---|---|
| 3,278,658 | A | 10/1966 | Immel | |
| 4,032,609 | A | 6/1977 | Smith | |
| 4,660,623 | A * | 4/1987 | Ashton | B22C 9/046 164/518 |
| 4,722,944 | A | 2/1988 | Mori | |
| 4,724,889 | A * | 2/1988 | McPherson | B22C 9/046 164/70.1 |
| 5,385,698 | A * | 1/1995 | Bishop | B22C 7/023 264/55 |
| 5,950,702 | A * | 9/1999 | Tan | B22C 7/023 164/249 |
| 6,358,459 | B1 | 3/2002 | Ziegler et al. | |
| 7,872,056 | B2 | 1/2011 | Cheung et al. | |
| 10,688,698 | B2 | 6/2020 | Bhargava et al. | |
| 2003/0006519 | A1 | 1/2003 | Kopp | |
| 2005/0059747 | A1 | 3/2005 | Berghmans et al. | |
| 2006/0058406 | A1 | 3/2006 | Matsumura et al. | |
| 2010/0029793 | A1 | 2/2010 | Witt et al. | |

(Continued)

FOREIGN PATENT DOCUMENTS

| | | | |
|---|---|---|---|
| JP | 2001347342 | A * | 12/2001 |
| JP | 2004114114 | A * | 4/2004 |

*Primary Examiner* — Kevin E Yoon
*Assistant Examiner* — Jacky Yuen
(74) *Attorney, Agent, or Firm* — Eversheds Sutherland (US) LLP

(57) ABSTRACT

Methods for forming metal articles are provided. The methods include forming foam casting molds from polylactic acid for use in lost foam and sand casting processes. The PLA-based foam casting molds advantageously reduce cycle time, reduce overall cost, increase reusability of the foam casting molds, reduce costs associated with shipping the foam casting mold, and improve yield and quality of cast metal articles.

22 Claims, 3 Drawing Sheets

(56) References Cited

U.S. PATENT DOCUMENTS

| | | | | |
|---|---|---|---|---|
| 2010/0222442 | A1 | 9/2010 | Prissok et al. | |
| 2013/0059938 | A1 | 3/2013 | Paetz-Lauter et al. | |
| 2013/0116352 | A1 | 5/2013 | Jo et al. | |
| 2024/0017451 | A1* | 1/2024 | Hisamatsu ..... | B29C 44/06 |

* cited by examiner

LOST FOAM AND SAND CASTING WITH POLYLACTIC ACID- BASED FOAM ARTICLES

CROSS-REFERENCE TO RELATED APPLICATION

This application claims priority to U.S. Provisional Application No. 63/386,676, filed Dec. 9, 2022, which is incorporated herein in its entirety.

FIELD OF THE DISCLOSURE

This disclosure relates generally to molded foam articles and, in particular, relates to the use of molded foam articles formed from polylactic acid in lost foam and sand casting.

BACKGROUND

Complex and custom metal parts are commonly made using molds into which molten metal is poured and allowed to cool into the desired metal article. Common molding techniques include sand casting, investment or lost-wax casting, and lost foam casting. Each of these techniques is characterized by forming a "negative" of the desired metal article and the pouring the metal into/around the sacrificial material (sand, wax, or foam), and then removing the sacrificial material so that only the metal article remains. Of these techniques, lost foam casting typically has the greatest flexibility due to the ability to easily form the desired metal shape using expandable foam particles. Sand casting is generally preferred over lost foam casting when extremely large and/or heavy metal articles are desired, which may prove too heavy for the foam "negative."

Lost foam casting is commonly used for producing parts such as automobile transmissions, engine manifolds, motor housings, ship and boat propulsion, pump housings, electric car battery chambers, commercial stove burners, conveyor parts, fire hydrants, and more. Sand casting is preferred over lost foam casting for articles such as architectural support struts, frames for cranes, and other large and heavy metal articles.

EPS-based foam has traditionally been well-suited for repetitive, high-volume lost foam castings of complex parts. The use of EPS has reduced machining costs, reduced core costs, reduced the cost of creating the sand mold compared to sand casting, reduced energy consumption, reduced labor, reduced material wastage, reduced material reprocessing, and various improvements in clustering or casting multiple parts. However, using EPS in lost foam casting produces a carbon residue on the cast metal part when the foam is burned away by the molten metal. The carbon residue can impact the surface of the cast metal article, affect the mechanical properties, and increase the likelihood of corrosion. For example, rapid pyrolysis of EPS (e.g., heating to around 1,400° C. at a rate of around 500° C./second) can leave 15% of the EPS material as carbon within the metal part. Furthermore, melting EPS with particularly high temperature molten metal can produce high boiling degradation products such as styrene and naptha which can recondense in the sand.

Because of these drawbacks in EPS, the preferred foam material for lost foam casting is expandable poly(methyl methacrylate) (ePMMA) due to its favorable post-expansion characteristics, namely, minimal shrinkage upon expansion into the foam mold intended for use in lost foam casting. However, ePMMA is expensive, up to ten times more expensive than expandable polystyrene (EPS). Furthermore, ePMMA foam is less consistent and less able to withstand the weight of the sand.

Sand casting, which typically utilizes reactive sand, requires a foam article capable of leaving an impression in the sand without reacting with the sand. Furthermore, the foam article must be of sufficient strength to withstand the weight of the surrounding sand without changes in the dimensions of the foam article. Conventional sand casting uses EPS foam, but the foam article is usually destroyed after one to four uses due to the extreme size of the foam article. Furthermore, to preserve the accuracy of the foam article relative to the desired cast metal article, the foam article must normally be constructed ahead of time and shipped with a secondary protective packaging, resulting in a significant waste in transportation capacity.

Accordingly, improved lost foam and sand casting techniques and materials are needed for overcoming one or more of the technical challenges described above.

BRIEF DESCRIPTION OF THE DRAWINGS

The detailed description is set forth with reference to the accompanying drawings. The use of the same reference numerals may indicate similar to identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1A:
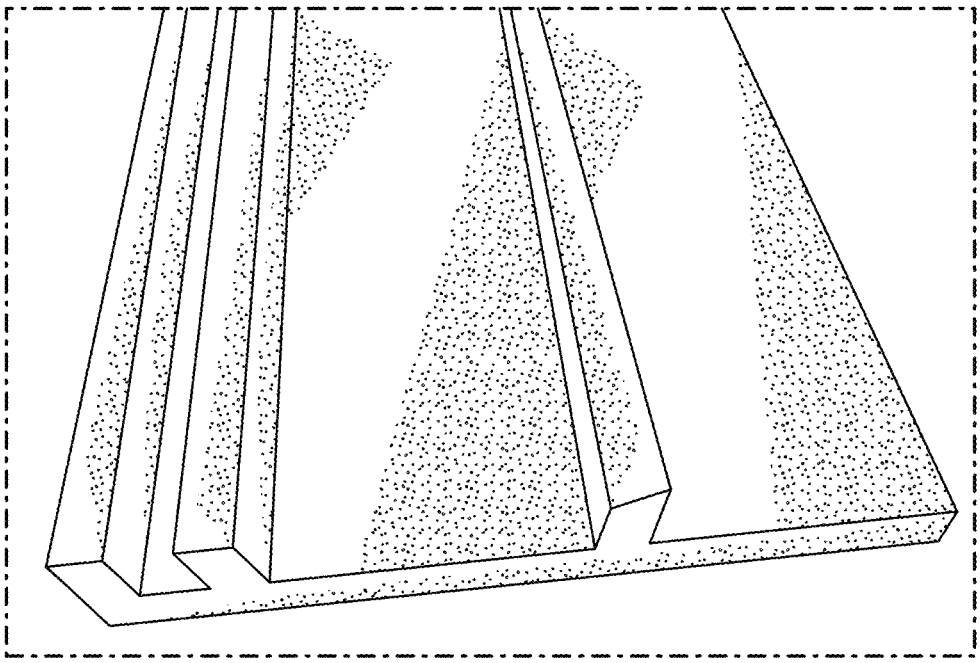
FIGS. 1A-1E depict a cast metal part in accordance with the present disclosure.
Figure 1B:
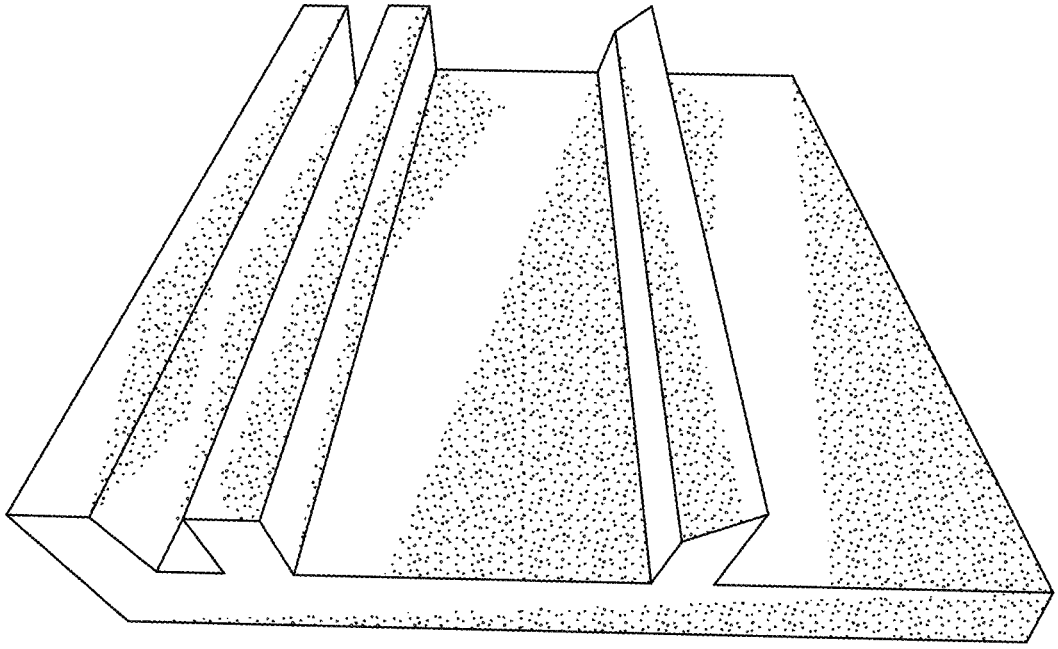
Figure 1C:
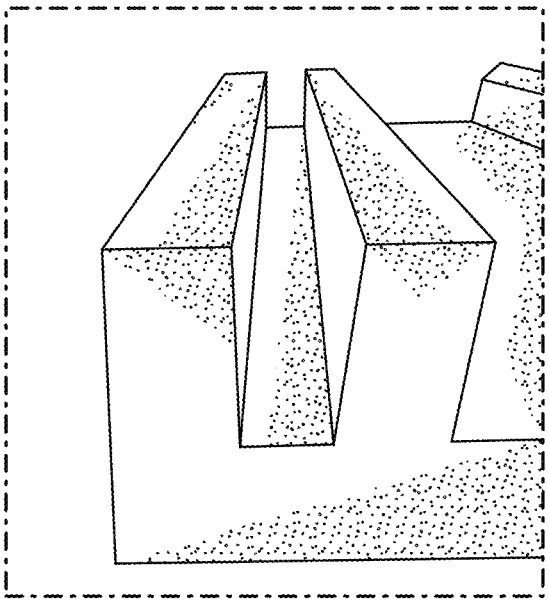
Figure 1D:
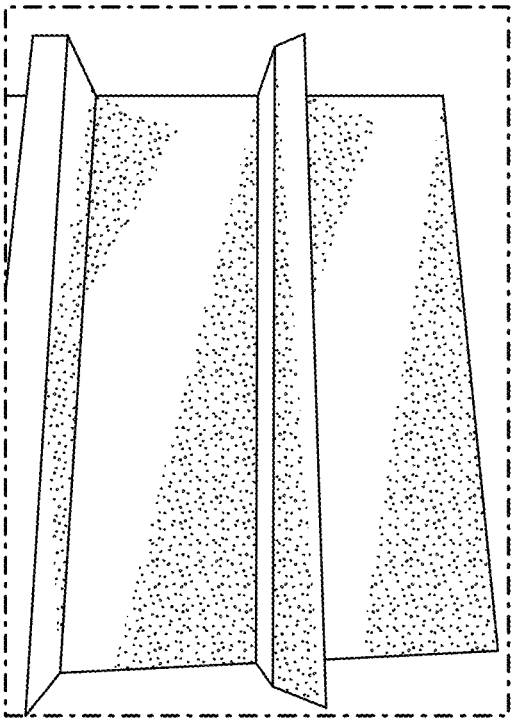
Figure 1E:
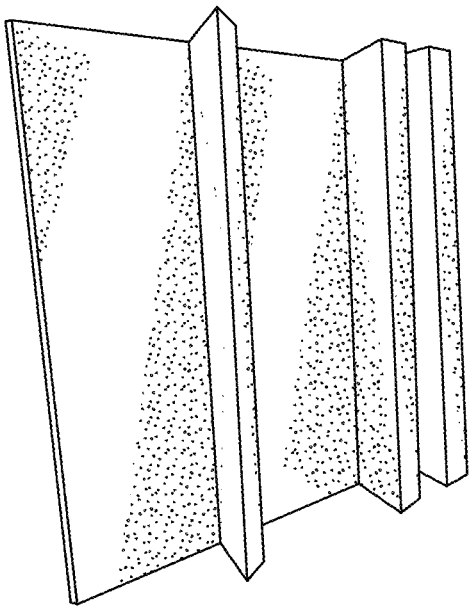

Methods for forming metal articles are provided herein including methods based on lost-foam casting and sand casting using foam molds formed from polylactic acid. In particular, it has been unexpectedly discovered that forming the foam casting mold from polylactic acid advantageously reduces or eliminates blowouts during lost foam metal casting, reduces failure rate of cast metal parts due to the casting process, reduces or eliminates reliance on nonrenewable resources, reduces or eliminates the production of toxic gases during the casting process, increases efficiencies in lost foam mold production, reduces or eliminates the need to ship large foam articles for use in sand casting, reduces overall cycle time by reducing or eliminating aging and drying steps, increases reusability of the foam mold, improves cast metal surface finish post-casting, introduces new possibilities in cast metal complexity and shape, reduces or eliminates changes in metal surface morphology during casting, introduces the ability to customize cast metal parts with high-resolution surface features, and introduces the ability to quickly and efficiently prototype metal parts.

Throughout this disclosure, various aspects are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6, etc., as well as individual numbers within that range, for example, 1, 2, 3, 4, 5, and 6. This applies regardless of the breadth of the range.

As used herein, the term "about" with reference to dimensions refers to the dimension plus or minus 10%.

Methods for Forming Metal Articles

Methods for forming metal articles are disclosed herein. In some embodiments, the methods include producing a foam casting mold. In some embodiments, producing the foam casting mold includes producing expandable foam beads formed from polylactic acid (PLA). In some embodiments, producing the foam casting mold includes molding the beads into a shape that corresponds to the metal article. As used herein, "molding" refers to the formation of an article from a polymeric foam that has gone through an expansion and bead molding process. The article may be in the form of a two-dimensional panel or a three-dimensional structure such as a box.

As used herein, "lost foam casting" refers to a process by which a foam article is formed into the shape of a desired metal article before being buried or surrounded in another medium, such as sand, before pouring molten metal onto the foam to melt and burn away the foam so that only metal remains in the cavity previously occupied by the foam. In this way, lost foam casting involves producing a foam article having the same shape as the desired metal article, and the foam article acts as a sacrificial material.

As used herein, "sand casting" refers to a process by which a pattern in the shape of a desired metal article is pressed into a bed of reactive sand to create a mold, incorporating a gating system for facilitating molten metal distribution, and then removing the pattern. After removal of the pattern, the reactive sand is allowed to solidify before casting molten metal into the mold. After the metal has cooled, the sand casing is broken away. The final cast metal article has a size and surface finish determined by the size and surface finish of the pattern itself. The "reactive sand" is characterized by the presence of various chemicals for changing refractoriness, chemical inertness, permeability, surface finish, cohesiveness, flowability, collapsibility, and availability. Traditionally, the pattern may be formed out of wood, metal, 3-D printed plastics, expandable polystyrene, or clay depending on the desired article and on the desired number of castings. For example, a metal pattern may be used to produce thousands of cast metal parts, but it's expensive and too heavy for larger cast metal parts. In contrast, EPS is inexpensive and lightweight, but might only be usable once before it breaks.

Sand casting differs from lost foam casting in the final handling of the pattern itself because the pattern is removed before casting metal into the sand casting mold. When a foam pattern is used, rather than sacrificing the foam by pouring molten metal on it, as in lost foam casting, the foam creates an impression in the sand before being removed, leaving behind a cavity in the shape of the desired metal article. Sand casting is preferred when the desired metal article is particularly large or heavy, such as around 50 pounds or greater; lost foam is challenging in these cases because of the large volume of degradation gases present in foams commonly used in lost foam, causing blowouts resulting in undesired pooling of metal. On the other hand, the smallest parts made with EPS distort or deform from the heavy weight of sand.

Conventional sand casting processes often result in destruction of the foam article due to its size. After pressing the foam article into the sand, removing the foam article involves applying sufficient force to the foam article to overcome friction forces with the reactive sand. The force necessary to disengage or dislodge the foam article from the sand often results in breakage or fracturing of the foam article.

By forming the foam casting mold from polylactic acid, the foam casting material may be formed completely from biobased materials. Expandable polylactic acid (PLA or EPLA), when molded and formed into a molded foam article, is capable of readily adhering to other PLA articles with minor surface treatment using heat, further eliminating the need for any petrochemical-based glues or adhesives. In some embodiments, the PLA pieces adhered together include protrusions, and these protrusions can withstand multiple sand-casting cycles. Thus, using PLA-based foam beads to form the foam casting mold advantageously reduces or eliminates the use or reliance on any nonrenewable resources and reduces or eliminates the use or reliance on high density glue, which results in significant yield improvements by reducing production of degradants during lost foam metal casting. Furthermore, the overflow of the glue that occurs when attaching 2 or 3 individual foam parts is visible in the metal part as an irregular raised defect. Eliminating glue results in eliminating such defects. The ability to self-adhere PLA-based foam articles further enables the formation of large foam articles for use in sand casting in pieces, rather than in one large, monolithic piece. This enables more compact shipping of foam articles. Self-adhesion also enables repairing a damaged mold by cutting the damaged piece off and adhering an undamaged piece in its place; this advantageously enables repairing easily broken portions with "spare" portions that are individually made and shipped alongside the main foam pattern. Self-adhesion further enables the formation of highly complex shapes by self-adhering gates, risers, and pour points without the use of glue, which are incapable of being molded in the first instance; these cannot be formed in EPS without glue or without the need to remove material through CNC or lathe machining.

PLA-based foam casting molds may also be "skin-formed," as described in U.S. patent application Ser. No. 18/356,611 to Lifoam Industries, LLC, which is hereby incorporated herein by reference. The skin-forming process results in a smooth surface having improved strength, further enhancing the PLA-based foam casting mold in ways that are impossible with EPS. Skin-forming further enables anisotropic enhancement of the PLA-based foam casting mold properties, making it stronger in, e.g., the vertical direction; this enables replacing the foam with lower density PLA bead foam without sacrificing the pattern's structural integrity. Skin-forming enables thinner foam parts which resist deforming under weight of sand. PLA-based bead foam is also resistant to the chemicals used in sand casting, such as phenol and isocyanate present in, for example, Sigmacure® 7121 resin for sand casting, available commercially from HA-International, LLC, Westmont, Illinois, United States.

The use of PLA-based foam for the pattern carries additional benefits at the foam pattern manufacturing step, before casting any metal. For example, PLA-based foam beads are biobased, compostable, and recyclable. The PLA-based bead foam molding process requires less energy and a negligible amount of water. PLA-based bead foam requires mere hours of drying, compared to several days' worth of drying for EPS-based molded foam articles.

Skin-formed PLA-based foam casting molds also have a superior surface finish, resulting in a cast metal part with a similarly superior surface finish that requires minimal-to-no post-processing to finish the metal part. The post processing steps eliminated involve steps to improve surface finish such as lapping and deburring.

Further still, PLA does not use toxic blowing agents, such as the pentane blowing agent characteristic of EPS. Using PLA-based foam beads to form the foam casting mold therefore has the additional benefit of reducing or eliminating the production of hazardous or flammable gases as part of the foam casting mold production process. PLA-based molded foam articles can be machined immediately following molding process unlike EPS which can take a week of wait time.

In some embodiments, the molded beads are in a first shape that corresponds to the shape of the metal article. In other embodiments, the molded beads are subsequently machined and/or combined with other molded bead foam to form the final shape.

In some embodiments, molding the beads into the shape requires less energy than a comparable expandable polystyrene molding process. The molding of PLA-based bead foam requires less heat and less pressure than EPS, and it can be performed with less water consumption. Furthermore, since EPS includes pentane as a blowing agent, foam casting molds produced from EPS must be aged for several weeks to allow residual pentane to degas. Without this aging step, residual pentane in EPS-based foam casting molds may ignite when the molten metal is poured into the mold. Therefore, in some embodiments, producing the foam casting mold does not include an aging process because PLA does not include a pentane-based blowing agent.

In some embodiments, producing the foam casting mold includes drying the molded beads. Conventional foam molds for lost foam casting formed from EPS or ePMMA require around two days of drying depending on part thickness to allow moisture depositing within the part to dry out. Without a drying step, this moisture may rapidly evaporate when molten metal is poured into and around the mold, resulting in ruptures in the foam mold and failure of the cast metal part. By using PLA-based foam beads to form the foam casting mold, which require only about two hours of drying or less, the PLA-based foam casting mold can proceed to the next step of the process much quicker. Therefore, in some embodiments, drying the molded beads is at least 75% faster than a comparable expandable polystyrene drying process.

In some embodiments, producing the foam casting mold includes conditioning the molded beads. This conditioning may include clustering two or more separate molded foam pieces together into a single, unitary foam piece corresponding to the desired metal article. Because PLA is used for the foam casting mold, no glue is needed for clustering two or more separate molded foam pieces because two PLA-based molded foam articles may be adhered together using heat, as described above. In contrast, EPS-based foam casting molds require glue, usually polyurethane-based glue or polyolefin-based-hot-melt glue, to adhere together. These glues are significantly denser than the EPS-based foam itself, impacting the volume of degradation gases generation during metal casting, and increasing the likelihood of blowouts. The conditioning may include combining two or three sections of a part, adding gates for the molten metal to pass into or through during the casting step. The conditioning may include forming a film or skin on the surface of the molded PLA beads by the application of heat and pressure, thereby smoothening the surface of the foam casting mold and improving the surface finish of the metal part. Forming a skin also results in densification of the foam beads at the surface of the PLA-based foam article, strengthening the article and enabling reusability of the mold in multiple sand casting processes. The conditioning may be performed manually or with the assistance of robotic or automated techniques. Any intermediate step necessary for preparing the molded foam article for use as a foam casting mold may be used.

In some embodiments, the method includes coating the foam casting mold with a refractory coating. Foam casting molds intended for pouring molten metal must be able to withstand at least the initial contact with the molten metal. After the metal had begun to cool, the foam casting mold is permitted to melt or otherwise disintegrate. Any refractory coating known in the industry may be used. Refractory coatings typically include zircon powder, bauxite, talc powder, quartz powder, mica powder, or another refractory material. The refractory material is combined with a solvent and a binder to form the refractory coating.

In some embodiments, the method includes drying the coated mold. In some embodiments, the method include investing the coated mold in sand. As used herein, "investing" refers to the practice of embedding or burying the mold partially in sand in order to keep the mold intact during the initial casting step. In some embodiments, the method includes casting molten metal into the invested mold. The molten metal can include lead, zinc, aluminum, bronze, brass, copper, titanium, cast iron, ductile iron, steel, stainless steel, nickel, wrought iron, or iron. The use of PLA-based foam patterns in lost foam casting enables casting low melting-point metals such as zinc and tin, which are not capable of lost foam casting when EPS-based foam patterns are used because the lower melting point is insufficient to burn away the EPS foam.

In some embodiments, the cast metal experiences no changes in surface morphology after the molten metal is cast. When EPS is used in the foam casting mold, carbon from pyrolysis of EPS is embedded in the metal castings. Thermogravimetric analysis of EPS and PLA pyrolysis reveals that no residue is produced by pyrolysis of PLA (except talc, if used to mold the PLA). In contrast, char and other carbon molecules are produced by pyrolysis of EPS. Stainless steel produced in this manner is prone to rusting or other surface defects. No such carbon deposits occur with PLA based foam casting molds. Furthermore, the surface finish of metals parts produced using lost foam or sand casting depends on the surface finish of the foam casting mold. When EPS is used, the same EPS beads that are used to form polystyrene drinking cups are used to ensure the metal article has a suitable surface finish. However, these "cup-sized" beads limit the size and thickness of the molded metal part. If the desired metal article is large, the surface finish will suffer when using EPS. In other words, the surface of the metal article will have a rough texture corresponding to the surface of the EPS article. When metal articles are formed through lost foam or sand casting using EPS-based foam articles, the metal article must normally go through a secondary polishing process to eliminate surface roughness. No such trade-off exists when using PLA because of the ability to form a skin on the surface of the PLA with heat and pressure, eliminating surface roughness and further reducing the need or degree of post-casting treatments.

In some embodiments, the PLA based foam casting mold includes one or more channels in one or more directions and/or angles. These channels, directions, and angles are necessary for creating highly irregular parts such as windmill parts and motor housing while including diagonal or cross bracing. Such cross bracing is not possible with ePMMA or EPS.

In some embodiments, such as when the PLA based foam casting mold is used for sand casting, the method includes removing the PLA based foam casting mold before casting the metal. By forming the foam casting mold from PLA, the foam casting mold is highly likely to be capable of reuse after removal from the sand casting apparatus. In some embodiments, the method includes intentionally fracturing or cutting the PLA based foam casting mold into two or more pieces to facilitate removal from the sand casting apparatus, followed by adhering the fractured pieces back together using heat as described herein to enable reuse of the PLA based foam casting mold.

In some embodiments, forming the PLA based foam pattern includes forming lettering within the pattern so that the lettering is imparted into the metal part. In some embodiments, the lettering can be imparted in smaller font sizes with PLA yet remain easily distinguishable.

In some embodiments, the method includes removing the cast metal from the sand. In some embodiments, the method include treating the cast metal to produce the metal article. Treating the cast metal may include performing an initial inspection of the cast metal. This initial inspection take significantly less time than an inspection of a metal article produced using an EPS-based foam casting mold because there are fewer blowouts and higher yield when using PLA. Treating the cast metal may include cutting or separating different metal parts from the mold when the mold used is configured to produce multiple metal articles simultaneously. Treating the cast metal may include grinding down excess metal where the gates were positioned in the mold. Treating the cast metal may include shot blasting, grinding, lapping, deburring or polishing the cast metal to improve the surface texture of the cast metal. Shot blasting, grinding, and polishing takes significantly less time than for a metal article producing using an EPS-based foam casting mold because the PLA-based mold has superior uniformity and surface characteristics. Treating the cast metal may include subjecting the cast metal to a heat treatment process. Treating the cast metal may include machining and assembling the metal article from disparate cast metal pieces. Treating the cast metal may include performing a surface treatment. Treating the cast metal may include performing a final inspection. Any suitable "post-casting" treatment necessary for finalizing the metal article from the cast metal may be used depending on the needs of the application.

In some embodiments, casting the molten metal include venting an exhaust to ambient air. Since PLA is used for the foam casting mold, no toxic gases are produced during the casting step. In contrast, EPS-based foam casting molds will produce styrene and other aromatic ring compounds that must be vented using hoods or afterburners in order to reduce toxic emissions. This is evident with reference to pyrolysis GC-MS analysis, presented below.

In some embodiments, blowback is reduced by at least 80% compared to lost foam casting with an EPS-based foam casting mold. As used herein, "blowback" refers to the gasification of polymeric foam during the casting process, resulting in mold failure and metal egress through the failure point. The gasification of polymeric foam is proportional to the weight of the foam, including any adhesive that may be present. If any adhesive is used in forming the foam casting mold, this adhesive is typically around 50 times denser than the foam. By forming the foam casting mold using PLA, no glue or adhesive is needed to form the mold; separate pieces of PLA-based foam can be joined using simple heat. In contrast, forming a mold using EPS requires an adhesive to join separate foam pieces. As a result, lost foam casting using EPS-based foam casting molds have a significantly higher rate of blowback than PLA-based foam casting molds.

In some embodiments, the molded beads are in the form of a single, monolithic molded foam article. EPS-based foam articles cannot be formed with thicknesses of greater than about 3-3.5 inches. In contrast, PLA-based foam articles can be 12+ inches thick. Thus, depending on the dimensions of the final metal article, using PLA enables the formation of a single foam piece for use as the foam casting mold.

EXAMPLES

Example 1: Forming PLA-Based Foam Pattern Suitable for Sand Casting

Two PLA-based foam pieces were prepared. One piece was 6"×9"×13" and the other piece was 6"×9"×17". The smaller piece was then heated to 350° F. for five seconds and then pressed into the other piece for several seconds with minimal force of 5 psi to form a column that was 6"×9"×30". A molded foam article of this size cannot be molded with traditional EPS-based molding techniques. Although not implemented in this example, it would be possible to adhere another 6"×9" piece to form an even taller column, or it could be attached to the side dimension to make a 6"×18"×30" PLA-based foam pattern. Additionally or alternatively, a PLA-based foam piece could be added perpendicular to create a large corner or any other shape.

To demonstrate that the joined PLA-based articles are suitable for sand casting, the joined articles were subjected to two different 3-point bend tests: one with weight placed in the middle of the joined articles on the interface between the joined articles, and another with weight placed on either end of the joined articles. For the first test, the joined articles withstood 100 lbs of weight on the interface between the joined articles without fracturing or bending. For the second test, 50 lbs of weight was placed on either end without fracturing or bending the joined articles.

Example 2: Analysis of EPS and PLA Rapid Degradation

Thermogravimetric analysis (TGA) is an analytical technique which measures the weight of a material as a function of temperature. Rapid TGA was used to simulate rapid degradation of EPS and PLA to compare char and oil produced during a pyrolysis process, such as the rapid melting of the foam during lost foam casting. This test investigated solid carbon generation which may be introduced to molten metal during the lost foam casting and which may influence corrosion in case of stainless steel, mild steels, grey iron and low alloy steels and reduce ductility of ductile iron. The TGA also lists the degradation level as function of temperature. Lower temperature of degradation is preferred as it means that less material is condensing within the sand.

Two types of TGA were carried out. First, the degradation was studied in air (i.e., an oxygen-containing environment). Second, the degradation was studied in a nitrogen-rich (i.e., anaerobic) environment. The rate of temperature increase was set to 200° C./min. Table 1 lists the amount of retained mass as a function of temperature.

TABLE 1

TGA Analysis of Retained Mass versus Temperature

| Temp (° C.) | EPS (air) (g) | EPS (no oxygen) (g) | PLA (air) (g) | PLA (no oxygen) (g) |
|---|---|---|---|---|
| 250 | 100 | 100 | 100 | 97 |
| 300 | 97 | 100 | 96 | 97 |
| 350 | 96 | 100 | 63 | 97 |
| 400 | 72 | 98 | 3.0 | 21 |
| 500 | 1.5 | 21 | 1.5 | 5.7 |
| 600 | 0.70 | 16 | 1.4 | 4.0 |
| 700 | 0.50 | 13 | 1.2 | 3.2 |
| 800 | 0.45 | 10.0 | 1.2 | 2.2 |
| Onset of Degradation | 390° C. | 468° C. | 322° C. | 375° C. |

The TGA test is still not rapid enough to fully capture high boiling or solid carbon degradation products which are produced during lost-foam casting. Noting that 10% residue in a test taking 4 minutes is lower than the industry known level of 16% when pyrolysis takes 3 seconds. The residue observed in the PLA sample was from talc used to aid production of PLA. In casting aluminum, this talc was observed floating on the molten metal before hardening, producing an easily removed coating. In any event, PLA bead foam can be produced without talc, which would result in a residue-free lost foam casting. The challenge with EPS in lost foam casting is the retained mass at high temperatures when pyrolyzed without oxygen. This retained mass is carbon and, when EPS is used in lost foam casting, it results in a carbon phase formed within the molten material.

Example 3: GC-MS Post Fast Pyrolysis of EPS and PLA

The test involved fast pyrolysis characterized by heating EPS and PLA beads from room temperature to 800° C. in less than 15 seconds using CDS Model 6200 Pyroprobe, available commercially from CDS Analytical LLC, Oxford, Pennsylvania, United States. The degradation products were separated using Agilent 6890 Gas Chromatograph/Agilent 5973 Mass Spectrometer, available commercially from Agilent Technologies Inc., Santa Clara, California, United States, equipped with a ZB5-MS column and quantified (with the exception of carbon monoxide, carbon dioxide and smaller molecules, which are not detected by this test). The degradation of EPS produced over 75 identifiable degradants with the major products being styrene, toluene, bibenzyl, methyl styrene, ethyl benzene, indene and naphthalene. PLA produced 15 major identifiable degradants being lactide, 2-butanone, glycidol, 1,4-Cyclohexadiene, 1,3-Cyclopentadiene, 2-methyl-Propanal. It is expected that PLA degradant level is dominated by $CO_2$, although $CO_2$ is not one of the degradation products tested for y the GC-MS.

In practice, the higher molecular weight species are expected to condense in the sand resulting in an increased likelihood of fire within the sand. Furthermore, the deposition of high molecular weight compounds affects how the sand flows, thereby affecting part uniformity. At the time of metal pouring, sand is typically between 130-150° F. and rises to above 250° F. upon casting. The analysis in this example revealed that the degradants from casting with PLA contain oxygen while the degradants from casting with EPS are aromatics. The enthalpy of combustion of the degradants with oxygen is 30-50% lower per gram compared to that of aromatics. In other words, the smaller number of degradation products condensing in the sand with PLA have a lower propensity for ignition during the casting step. Furthermore, condensing higher molecular weight degradants causes sand to clump, thereby causing gaps in sand when the patterns are invested in sand.

Dividing the degradation product relative amount by molecular weight provides a quick screen for species which can condense in the sand. In Table 2 below, the majority of degradants produced by pyrolysis of EPS have a molecular weight greater than 100 Daltons while those produced by pyrolysis of PLA degradants have a lower molecular weight.

TABLE 2

Relative molecular weight of degradants produced by pyrolysis

| Molecular weight (Daltons) | EPS | PLA |
|---|---|---|
| Less than 100 | 6% | 64% |
| Between 100-144 | 78% | 36% |
| Between 144-265 | 15% | — |

Example 4: Drying Time Analysis for PLA-Based Foam Patterns

Moisture contained with the PLA-based foam pattern depends on the part thickness, as described in U.S. patent application Ser. No. 17/656,700 to Lifoam Industries LLC. U.S. patent application Ser. No. 17/656,700 also provides that molding PLA-based foam requires less energy than a comparable EPS molding process. For this trial, a 2.5" thick part was studied as it is expected to have higher moisture level. Four pieces were taken from the molding process immediately after being ejected, weighed, and placed in a thermal chamber set at 60° C. (140° F.). The pieces were removed from the chamber every hour for the first five hours and a weight was quickly taken before replacing the pieces back in the chamber. The results are displayed in Table 3.

TABLE 3

Analysis of PLA weight over time

Weight (g) versus Time

| PLA Samples | 0 hours (g) | 1 hour (g) | 2 hours (g) | 3 hours (g) | 4 hours (g) | 5 hours (g) | 22 hours (g) | 23 hours (g) | 24 hours (g) |
|---|---|---|---|---|---|---|---|---|---|
| Sample 1 | 200.7 | 193.6 | 192.9 | 192.6 | 192.6 | 192.3 | 192.3 | 192.3 | 192.3 |
| Sample 2 | 198.6 | 193.2 | 192.2 | 192.2 | 191.9 | 191.9 | 191.9 | 191.9 | 191.9 |
| Sample 3 | 193.4 | 191.7 | 190.6 | 190.6 | 190.2 | 190.2 | 190.2 | 190.2 | 190.2 |
| Sample 4 | 192.4 | 190.5 | 189.5 | 188.6 | 188.3 | 188.3 | 188.3 | 188.3 | 188.3 |

TABLE 3-continued

| Analysis of PLA weight over time | | | | | | | | | |
|---|---|---|---|---|---|---|---|---|---|
| % of Weight versus Starting Weight | | | | | | | | | |
| PLA Sample | 0 hours | 1 hour | 2 hours | 3 hours | 4 hours | 5 hours | 22 hours | 23 hours | 24 hours |
| Sample 1 | 100% | 96.5% | 96.1% | 96.0% | 96.0% | 95.8% | 95.8% | 95.8% | 95.8% |
| Sample 2 | 100% | 97.3% | 96.8% | 96.8% | 96.6% | 96.6% | 96.6% | 96.6% | 96.6% |
| Sample 3 | 100% | 99.1% | 98.6% | 98.6% | 98.3% | 98.3% | 98.3% | 98.3% | 98.3% |
| Sample 4 | 100% | 99.0% | 98.5% | 98.0% | 97.9% | 97.9% | 97.9% | 97.9% | 97.9% |
| % Lost versus Time | | | | | | | | | |
| PLA Sample | 0 hours | 1 hour | 2 hours | 3 hours | 4 hours | 5 hours | 22 hours | 23 hours | 24 hours |
| Sample 1 | 0% | 3.5% | 3.9% | 4.0% | 4.0% | 4.2% | 4.2% | 4.2% | 4.2% |
| Sample 2 | 0% | 2.7% | 3.2% | 3.2% | 3.4% | 3.4% | 3.4% | 3.4% | 3.4% |
| Sample 3 | 0% | 0.9% | 1.4% | 1.4% | 1.7% | 1.7% | 1.7% | 1.7% | 1.7% |
| Sample 4 | 0% | 1.0% | 1.5% | 2.0% | 2.1% | 2.1% | 2.1% | 2.1% | 2.1% |
| % of Total Loss versus Time | | | | | | | | | |
| PLA Sample | 0 hours | 1 hour | 2 hours | 3 hours | 4 hours | 5 hours | 22 hours | 23 hours | 24 hours |
| Sample 1 | 0.0% | 84.5% | 92.9% | 96.4% | 96.4% | 100.0% | 100.0% | 100.0% | 100.0% |
| Sample 2 | 0.0% | 80.6% | 95.5% | 95.5% | 100.0% | 100.0% | 100.0% | 100.0% | 100.0% |
| Sample 3 | 0.0% | 53.1% | 87.5% | 87.5% | 100.0% | 100.0% | 100.0% | 100.0% | 100.0% |
| Sample 4 | 0.0% | 46.3% | 70.7% | 92.7% | 100.0% | 100.0% | 100.0% | 100.0% | 100.0% |

The moisture level varied piece-by-piece. However, in each case, the dry weight was reached within 4 to 5 hours as evidenced by the % of Total Loss over time reaching 100% for every sample in 4-5 hours. This is surprisingly low compared to EPS and EPMMA materials which each take 16 to 24 hours to reach a dry weight.

Example 5: Smoothness of Aluminum Cast Via Lost Foam Casting

Aluminum was cast using lost foam casting with both a skin-formed PLA-based foam pattern and an EPS-based foam pattern using T-beads. After casting, the surface roughness was measured on an Amtast® Roughness tester (AMT211), available commercially from Amtast USA Inc., Lakeland, Florida, United States. This device confirmed to ISO, ANSI, DIN, and JIS standards.

The test was conducted according to ISO 4287: Geometrical Product Specifications and ISO 16610-21: Geometrical Product Specifications. The GAUSS (gaussian) filter (set by ISO 11562) was used, which had a set amount of approach travel, pre-travel, assessment length, and then post-travel as well as returning back to the initial point before calculating surface roughness. The entire range of the test was 20 mm with the cut-off on either side at 0.8 mm. The range that the stylus could measure roughness in the z-axis is 320 μm (microns) with a tolerance of 0.08 μm.

The surface roughness gauge used has a stylus point which touched the material being measured and traces the surface at a constant rate. The machine acquired the surface roughness by the sharp stylus' contact since roughness of the article causes the stylus to be displaced up or down. As the stylus moved its position, the inductive value of induction coils inside of the sensor body sent an analogue signal to the machine which was collected and then analyzed based on the ISO tests mentioned above.

A total of 4 analyses each were conducted on the cast aluminum parts. The results are displayed in Table 4.

TABLE 4

| Comparison of Cast Metal Surface Roughness | | | | | | | | |
|---|---|---|---|---|---|---|---|---|
| Material | $R_a$ Average | $R_a$ Std Dev | $R_a$ Min | $R_a$ Max | $R_{max}$ Average | $R_{max}$ Std Dev | $R_{max}$ Min | $R_{max}$ Max |
| Cast Aluminum Surface With T-Bead EPS | 30 | 24.5 | 16 | 58 | 273 | 216 | 118 | 520 |
| Cast Aluminum Surface With Skin-Formed PLA | 26 | 3.1 | 24 | 29 | 177 | 26 | 159 | 195 |

As shown in Table 4, the surface of the aluminum part cast using a skin-formed PLA-based foam pattern was not only smoother, but this smoothness was more consistent across the cast metal.

Example 6: Cast Part with PLA-Based Pattern

FIGS. 1A-1E show cast metal parts formed using a PLA pattern having thin fins attached to a PLA base. By forming the PLA pattern with these thin fins, something otherwise impossible with EPS-based patterns, uniform fins may be formed in the metal without being deformed. Furthermore, the close proximity of the first two fins with respect to the channel depth between them is challenging to form with EPS-based patterns.

Figure 2A:
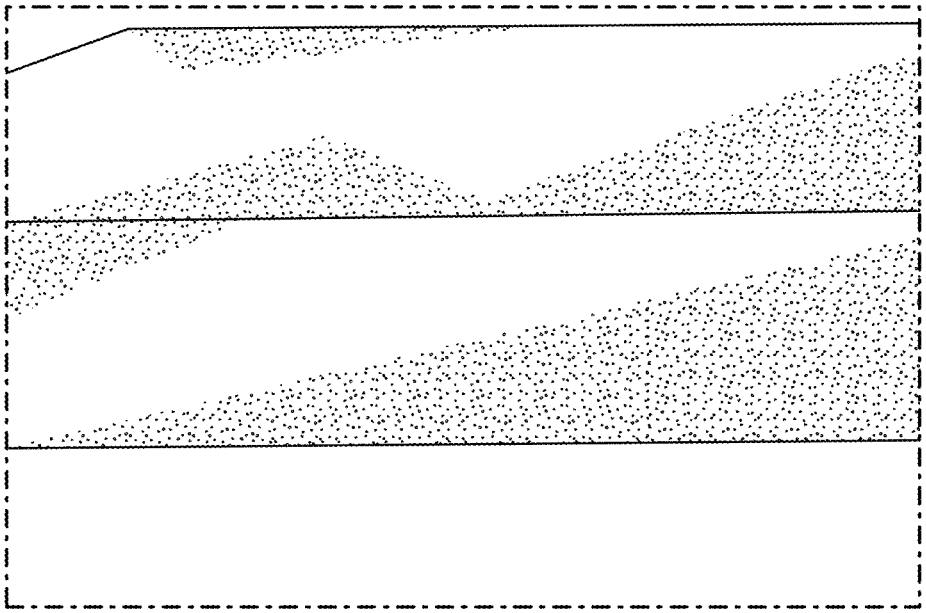
FIGS. 2A-2B depict a cast metal part in accordance with the present disclosure.
Figure 2B:
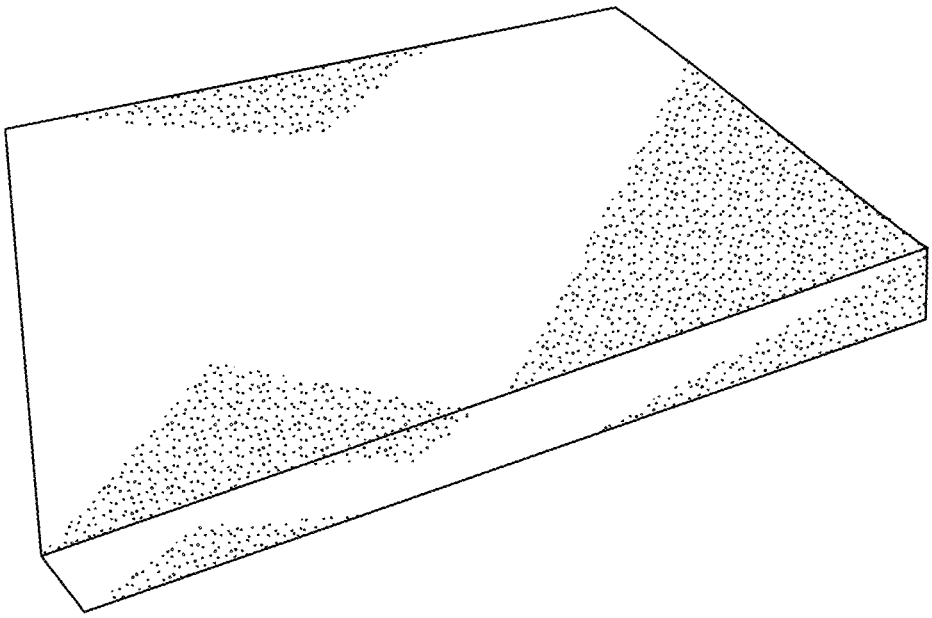

FIGS. 2A-2B depict debossed lettering. The debossing was incorporated into the surface of a PLA-based pattern using skin-forming, another process impossible with EPS-based patterns. After casting, the debossing in the PLA-based pattern results in embossed lettering within the metal part. The size of debossed markings with PLA can be reduced in size and remain visible.

While the disclosure has been described with reference to a number of embodiments, it will be understood by those skilled in the art that the disclosure is not limited to such embodiments. Rather, the disclosure can be modified to incorporate any number of variations, alterations, substitutions, or equivalent arrangements not described herein, but which are commensurate with the spirt and scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements or functional capabilities. Additionally, while various embodiments of the disclosure have been described, it is to be understood that aspects of the disclosure may include only some of the described embodiments. Accordingly, the disclosure it not to be seen as limited by the foregoing described, but is only limited by the scope of the appended claims.

That which is claimed is:

1. A method for forming a metal article, the method comprising:

producing a foam casting mold, wherein producing the foam casting mold comprises:

producing expandable foam beads formed from polylactic acid, molding the expandable foam beads into a foam article having a first shape, wherein the foam article corresponds to the metal article, drying the foam article, conditioning the foam article, and exposing a surface of the foam article to heat and pressure to form a skin from the expandable foam beads on the surface of the foam article to form the foam casting mold;

investing the foam casting mold in sand;

casting molten metal into the invested mold;

removing the cast metal from the sand; and treating the cast metal to produce the metal article.

2. The method of claim 1, further comprising removing the invested foam casting mold from the sand after investing such that an impression of the foam casting mold remains in the sand.

3. The method of claim 1, wherein the foam casting mold is sacrificed when the molten metal is cast into the invested mold.

4. The method of claim 3, further comprising:

coating the foam casting mold with a refractory coating, and drying the coated foam casting mold before investing the coated foam casting mold in sand.

5. The method of claim 1, further comprising machining the foam article into a second shape before drying.

6. The method of claim 1, wherein the expandable foam beads do not include pentane and the foam article does not need to be aged.

7. The method of claim 1, wherein drying the foam article is at least 75% faster than a comparable expandable polystyrene drying process.

8. The method of claim 1, wherein drying the foam article occurs in approximately 4 hours or less.

9. The method of claim 1, wherein conditioning the foam article comprises:

clustering two or more separate foam articles together into a single, unitary foam piece, adding gates, risers, and pour points, and forming a film for improved surface finish, wherein conditioning the foam article may be performed manually or using robots.

10. The method of claim 1, wherein no drying step is necessary after conditioning the foam article because no glue is used for surface finish.

11. The method of claim 1, wherein casting the molten metal further comprises venting an exhaust to ambient air because no toxic gases are produced.

12. The method of claim 1, wherein treating the cast metal comprises one or more of:

performing an initial inspection of the cast metal, cutting or separating metal parts when the foam casting mold used is configured to produce multiple metal articles simultaneously, grinding gates, shot blasting, grinding, and polishing the cast metal, subjecting the cast metal to a heat treatment process, machining and assembling the metal article from disparate cast metal pieces, performing a surface treatment, and performing a final inspection.

13. The method of claim 12, wherein the initial inspection takes less time than a comparable cast metal formed using an expandable polystyrene mold.

14. The method of claim 12, wherein shot blasting, grinding, lapping, deburring and polishing takes less time than a comparable cast metal formed using an expandable polystyrene mold.

15. The method of claim 1, wherein blowback is reduced by at least 80% compared to lost foam casting with expandable polystyrene.

16. The method of claim 1, wherein only biobased materials are used in producing the foam casting mold.

17. The method of claim 1, wherein no toxic gases are producing during the casting step.

18. The method of claim 1, wherein the foam article comprises a single, monolithic molded foam article.

19. The method of claim 1, wherein the surface of the cast metal is smoother than cast metal using expandable polystyrene.

20. The method of claim 1, wherein the cast metal experiences no changes in surface morphology from entrapped carbon after the molten metal is cast.

21. The method of claim 1, wherein the foam article has a minimum thickness of approximately three beads thick.

22. The method of claim 1, wherein the molten metal is aluminum, bronze, brass, copper, iron, cast iron, ductile iron, wrought iron, steel, stainless steel, nickel, lead, or zinc.

* * * * *